US005582148A

United States Patent [19]

Hashimoto et al.

[11] Patent Number: 5,582,148

[45] Date of Patent: Dec. 10, 1996

[54] CONTROL SYSTEM FOR THE QUANTITY OF AIR TO BE INDUCTED INTO ENGINE

[75] Inventors: Shoji Hashimoto; Toru Hashimoto; Koichi Namiki; Takuya Matsumoto, all of Tokyo, Japan

[73] Assignee: Mitsubishi Jidosha Kogyo Kabushiki Kaisha, Tokyo, Japan

[21] Appl. No.: 379,477

[22] PCT Filed: May 30, 1994

[86] PCT No.: PCT/JP94/00854

§ 371 Date: Jun. 1, 1995

§ 102(e) Date: Jun. 1, 1995

[87] PCT Pub. No.: WO94/28295

PCT Pub. Date: Dec. 8, 1994

[30] Foreign Application Priority Data

Jun. 1, 1993 [JP] Japan ..... 5-130692

[51] Int. Cl.[6] ..... F02D 41/08; F02D 41/16

[52] U.S. Cl. ..... 123/339.22; 123/339.24

[58] Field of Search ..... 123/339.22, 339.23, 123/339.24, 339.27

[56] References Cited

FOREIGN PATENT DOCUMENTS 64-87843 3/1989 Japan .

1-240748 9/1989 Japan .

1-253542 10/1989 Japan ..... 123/339.22

3-37277 4/1991 Japan .

4-136444 5/1992 Japan .

5-23829 6/1993 Japan .

*Primary Examiner*—Tony M. Argenbright

[57] ABSTRACT

This invention relates to a control system for the quantity of air to be inducted, which is suitable for use in controlling the idling speed of an engine, for example, for an automotive vehicle or the like. It is an object of the present invention to permit a change of the same degree to the quantity of air to be inducted for the compensation of a load without being affected by the temperature of the engine and also to precisely obtain inducted air in a quantity required inherently. The control system is constructed of STM valve (12) interposed in a bypass passage (11) of a throttle valve (8), ROM (36) for storing opening data for the setting of the position of the STM valve (12), the opening data corresponding to engine operation states, a limiter (13) interposed in the bypass passage (11) in series with the STM valve (12), the opening of the limiter being variable depending on the engine temperature, target opening setting device (45,46) for correcting a target opening on the basis of the engine temperature upon setting the target opening on the basis of the opening data obtained from the ROM (36) in accordance with an engine operation state, and an ISC driver (44) for controlling the opening of the STM valve (12) to the target opening from the target opening setting device (45,46).

8 Claims, 7 Drawing Sheets

FIG. 4
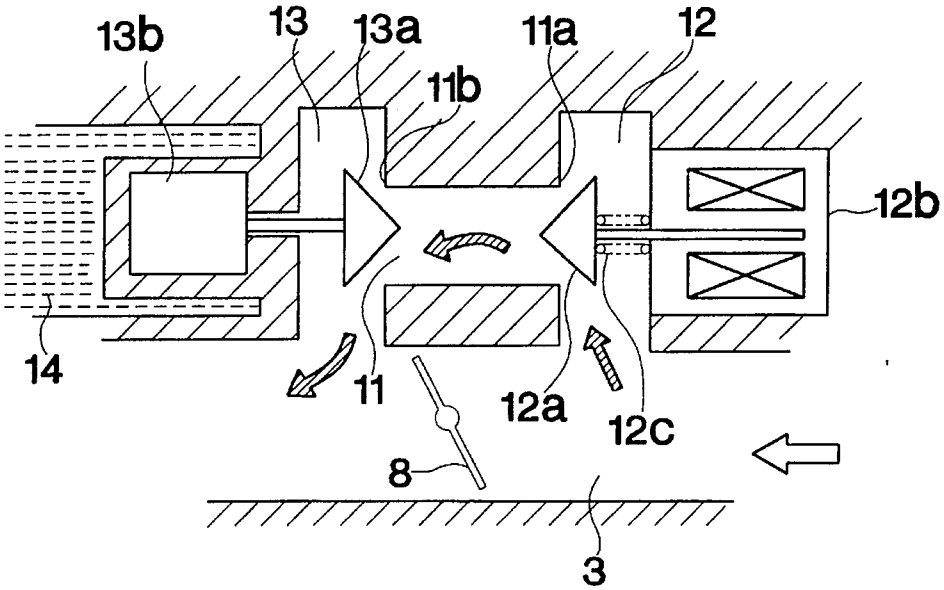
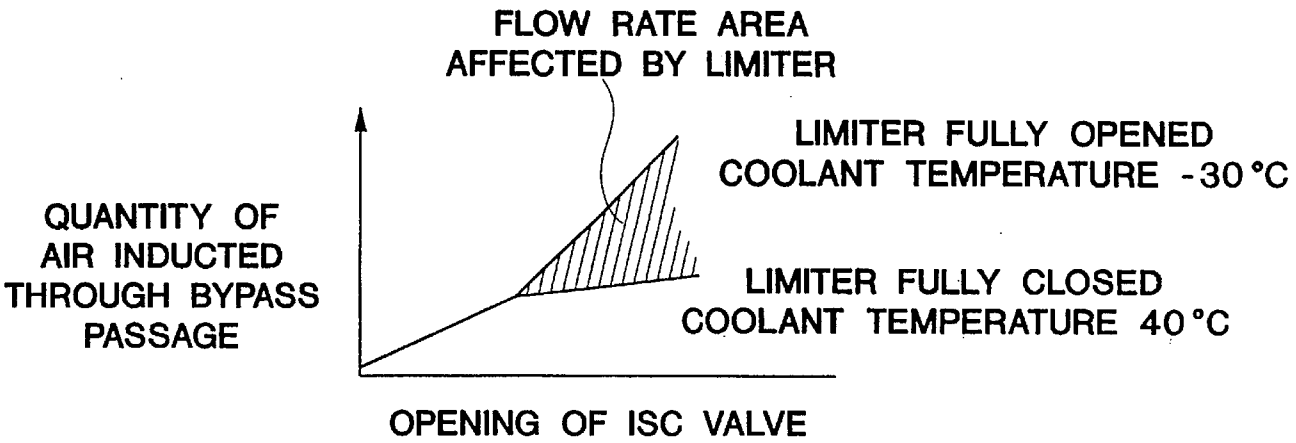
FIG. 11

| COOLANT TEMPE-RATURE / OPENING | -30 | -10 | +10 | +20 | +30 | +40 | +80 |
|---|---|---|---|---|---|---|---|
| 40 | 0.9 | 0.9 | 0.9 | 0.9 | 0.9 | 1 | 1 |
| 60 | 0.7 | 0.8 | 0.9 | 0.9 | 0.9 | 1 | 1 |
| 80 | 0.6 | 0.7 | 0.8 | 0.9 | 0.9 | 1 | 1 |
| 100 | 0.5 | 0.6 | 0.7 | 0.8 | 0.9 | 1 | 1 |
| 120 | 0.5 | 0.6 | 0.7 | 0.8 | 0.9 | 1 | 1 |

CONTROL SYSTEM FOR THE QUANTITY OF AIR TO BE INDUCTED INTO ENGINE

TECHNICAL FIELD

This invention relates to a control system for the quantity of air to be inducted into an engine, which is suitable for use in controlling the idle speed (idling speed) of an engine, for example, for an automotive vehicle or the like.

BACKGROUND ART

Techniques have already been proposed to accurately control the idling speed of an engine in correspondence with the speed and temperature of the engine and the operation states of accessories installed in association with the engine, such as an air conditioner and a power steering, by arranging an idling speed control valve [hereinafter called an "ISC (idle speed control) valve"] in a throttle bypass passage and controlling the opening of the ISC valve on the basis of signals indicative of the respective operation states.

According to such a technique, target openings (or target engine speeds) corresponding to respective engine temperatures are set in advance. The ISC valve is first controlled to a target opening (or at an opening which makes it possible to control the engine speed to a target engine speed). When a change occurs in the load of the air conditioner or the like, the opening of the ISC valve is controlled further by a degree corresponding to the kind of the change in the load so that any change in the engine speed due to the change in the load can be compensated.

In this technique, the ISC valve is designed to permit setting the quantity of inducted air in a wide range from the setting of a large quantity of inducted air required at the time of a cold engine state to the setting of a small quantity of inducted area needed at the time of a hot engine state because there is a large difference between the quantity of air to be inducted through a throttle bypass passage required at the time of the cold engine state and the quantity of air to be inducted through the throttle bypass passage needed at the time of the hot engine state. The above technique therefore involves the problem that the idling speed becomes higher at the time of a hot state than it is needed if any trouble occurs on the ISC valve or its drive circuit or the like and the ISC valve is hence fixed at the setting for the large quantity of inducted air for the time of the cold state.

As is disclosed in Japanese Patent Application Laid-Open (Kokai) No. SHO 64-87843 or the like, a technique has been proposed accordingly to arrange a valve element (limiter), which operates responsive to the temperature of the engine, in the bypass passage in series with the ISC valve so that at the time of a hot state, especially, the maximum quantity of air inducted and flowing through the bypass passage at the time of the hot state is limited to prevent any unnecessary increase in the idling speed.

The arrangement of such a limiter in the bypass passage is however accompanied by the problem that the flow rate so controlled is affected by the opening of the limiter, for example, as shown in FIG. 11 especially when the opening of the ISC valve is relatively large.

Described specifically, consider, for example, the state that the engine temperature is relatively low (in this case, the maximum bypass flow rate by the limiter is relatively high) and most of accessories to the engine are not operated (State A) and the state that the engine temperature is relatively high (in this case, the maximum bypass flow rate by the limiter is relatively low) and most of the accessories other than a specific accessory are operated (State B). Assume that in each of the states, the opening of the ISC valve is substantially the same in a relatively high opening range.

Also assume that operation of the specific accessory was started from this state and the opening of the ISC valve has been increased by a degree preset corresponding to the accessory in both the states. Although the opening has been increased by the same degree in both State A and State B, the influence of the limiter is smaller in State A so that the quantity of air to be inducted is increased by a greater degree whereas the influence of the limiter is relatively greater in State B so that the quantity of air to be inducted is increased by a smaller degree. Consequently, despite the occurrence of the same load by the same accessory in both the states, the increase in the quantity of air to be inducted for the compensation of the load is affected by the engine temperature and is hence not performed by the same degree.

Further, consider the above situation under the same temperature condition. The influence by the limiter is small when the opening of the ISC valve is relatively small but, when the above opening becomes relatively large, the degree of influence of the limitation to the flow rate by the limiter increases. Here again, there is the problem that air to be inducted cannot be obtained precisely in a quantity inherently required in accordance with the degree of influence by the limier on the basis of the opening of the ISC valve if the change in the opening of the ISC valve is simply set at a fixed value in correspondence to a change in a specific operation state typified by a change in the operation of the accessory.

The present invention has been completed with such problems in view, and has as an object the provision of a control system for the quantity of air to be inducted into an engine so that, where an ISC valve and a limiter are arranged in series with each other in a bypass passage, the opening of the ISC valve is controlled while applying a correction in accordance with the state of temperature of the engine, thereby making it possible to independently make a change to the quantity of air inducted for the compensation of a load without being affected by the engine temperature and also to accurately obtain inducted air in a quantity inherently required in accordance with the degree of influence of the limiter which varies based on the opening of the ISC valve.

DISCLOSURE OF THE INVENTION

Accordingly, a control system according to the present invention for the quantity of air to be inducted into an engine comprises: a first control valve interposed in a bypass passage which bypasses a throttle valve disposed in an intake passage of the engine; means for storing opening date for setting the position of the first control valve, the opening data having been preset corresponding to operation states of the engine; a second control valve interposed in the bypass passage so that the second control valve is located in series with the first control valve, the opening of the second control valve being variable depending on the temperature state of the engine; means for setting a target opening of the first control valve by detecting an operation state of the engine and obtaining the opening data corresponding to the operation state from the storage means and also for performing, upon setting the target opening on the basis of the opening data so obtained, correction of the target opening on the basis of at least one of information on a temperature state of the engine and information on an opening of the first control valve; and valve opening setting means for controlling the opening of the first control valve to the target opening set by the target opening setting means.

The storage means may store first opening data for a hot state of the engine and second opening data corresponding to operation states of an accessory of the engine, and the target opening setting means may comprises first setting means for setting a tentative target opening by using both the first opening data and the second opening data, and second setting means for making correction to the tentative opening, which has been set by the first setting means, on the basis of at least one of the information on the temperature state of the engine and the information on the opening of the first control valve and hence setting the target opening.

The storage means may store the opening data corresponding to a difference between an engine speed and a target engine speed; and the target opening setting means may comprise first setting means for setting a tentative target opening by using both another tentative target opening, which has been set immediately before, and the opening data, and a second setting means for making correction to the tentative target opening, which has been set by the first setting means, on the basis of at least one of the information on the temperature state of the engine and the information on the opening of the first control valve and hence setting the target opening.

The target opening setting means may make the correction to the target opening on the basis of both the information on the temperature state of the engine and the information on the opening of the first control valve.

The storage means may store target opening correcting correction coefficients corresponding to at least one of information on temperature states of the engine and information on openings of the first control valve; and the target opening setting means may obtain from the storage means the correction coefficient corresponding to at least one of information on a temperature state of the engine and information on an opening of the first control valve and may multiply the target opening by the correction coefficient so obtained, whereby the correction of the target opening is performed. Here, the correction coefficients may be set so that the correction coefficients become smaller as the temperature of the engine decreases or the opening of the first control valve increases.

The storage means may store target opening correcting correction coefficients as a map corresponding to the information on the temperature state of the engine and the information on the opening of the first control valve; and the target opening setting means may obtain from the map in the storage means the correction coefficient corresponding to the information on the temperature state of the engine and the information on the opening of the first control valve and may multiply the target opening by the correction coefficient so obtained, whereby the correction of the target opening is performed. The correction coefficients may be set so that the correction coefficients become smaller as the temperature of the engine decreases or the opening of the first control valve increases.

According to the control system of this invention for the quantity of air to be inducted into the engine, opening data corresponding to an operation state of the engine is read from the storage means by the target opening setting means. Upon setting the opening data as a target opening for the first control valve, correction is made to the opening data (the target opening for the first control valve) on the basis of at least one of information on a temperature state of the engine and information on an opening of the first control valve. The opening of the first control valve is then controlled by the valve opening setting means to the target opening set by the target opening setting means.

Further, the storage of the first opening data for the hot state of the engine and the second opening data corresponding to operation states of an accessory of the engine in the storage means makes it possible, upon setting a target opening for the first control valve by the target opening setting means, to set a tentative target opening by the first setting means on the basis of both the first opening data and the second opening data and then to make correction to the tentative opening by the second setting means on the basis of at least one of the information on the temperature state of the engine and the information on the opening of the first control valve and hence to set the target opening.

The storage of the opening data corresponding to a difference between an engine speed and a target engine speed in the storage means makes it possible—upon setting a target opening for the first control valve by the target opening setting means—to set a tentative target opening by the first setting means on the basis of both another tentative target opening, which has been set immediately before, and the opening data and then to make correction to the tentative target opening by the second setting means on the basis of at least one of the information on the temperature state of the engine and the information on the opening of the first control valve and hence to set the target opening.

At the target opening setting means, the correction to the target opening can be made on the basis of both the information on the temperature state of the engine and the information on the opening of the first control valve.

The storage of the target opening correcting correction coefficients in the storage means, said coefficients corresponding to at least one of information on temperature states of the engine and information on openings of the first control valve (and optionally becoming smaller as the temperature of the engine decreases or the opening of the first control valve increases), makes it possible—upon making correction to the target opening for the first control valve by the target opening setting means—to obtain from the storage means the correction coefficient corresponding to at least one of information on a temperature state of the engine and information on an opening of the first control valve and then to multiply the target opening by the correction coefficient so obtained, whereby the correction of the target opening can be performed.

The storage of the target opening correcting correction coefficients as a map in the storage means, said coefficients corresponding to the information on the temperature state of the engine and the information on the opening of the first control valve (and optionally becoming smaller as the temperature of the engine decreases or the opening of the first control valve increases), makes it possible—upon making correction to the target opening for the first control valve by the target opening setting means—to obtain from the map in the storage means the correction coefficient corresponding to the information on the temperature state of the engine and the information on the opening of the first control valve and then to multiply the target opening by the correction coefficient so obtained, whereby the correction of the target opening can be performed.

According to the control system of this invention for the quantity of air to be inducted into the engine, the system is provided with the means for storing the opening data for the first control valve, said opening data having been set in advance corresponding to an operation state of the engine (the temperature state of the engine, the engine speed or the state of operation of an accessory). By the target opening setting means, the operation state of the engine is detected, the opening data corresponding to the operation state is obtained from the storage means, and the tentative target opening for the first control valve is then set. The tentative target opening is thereafter corrected based on at least one of the information on the temperature state of the engine and the information on the opening of the first control valve. The control system therefore has the advantages that a change to the quantity of air to be inducted for the compensation of a load can be effected independently without being affected by the temperature of the engine and inducted air can be obtained precisely in an inherently-needed quantity on the basis of the opening of the first control valve and in accordance with the degree of influence by the second control valve.

BRIEF DESCRIPTION OF THE DRAWINGS

FIG. 4 is a cross-sectional drawing schematically illustrating the construction of an idling speed control (ISC) device in the present embodiment;

FIG. 11 is a graph depicting influence of the opening of the ISC valve (STM valve) and that of the limiter to the quantity of air to be inducted bypassing a throttle.

BEST MODE FOR CARRYING OUT THE INVENTION

With reference to the drawings, a description will hereinafter be made of a control system according to the one embodiment of the present invention for the quantity of air to be inducted to an engine.

Figure 3:
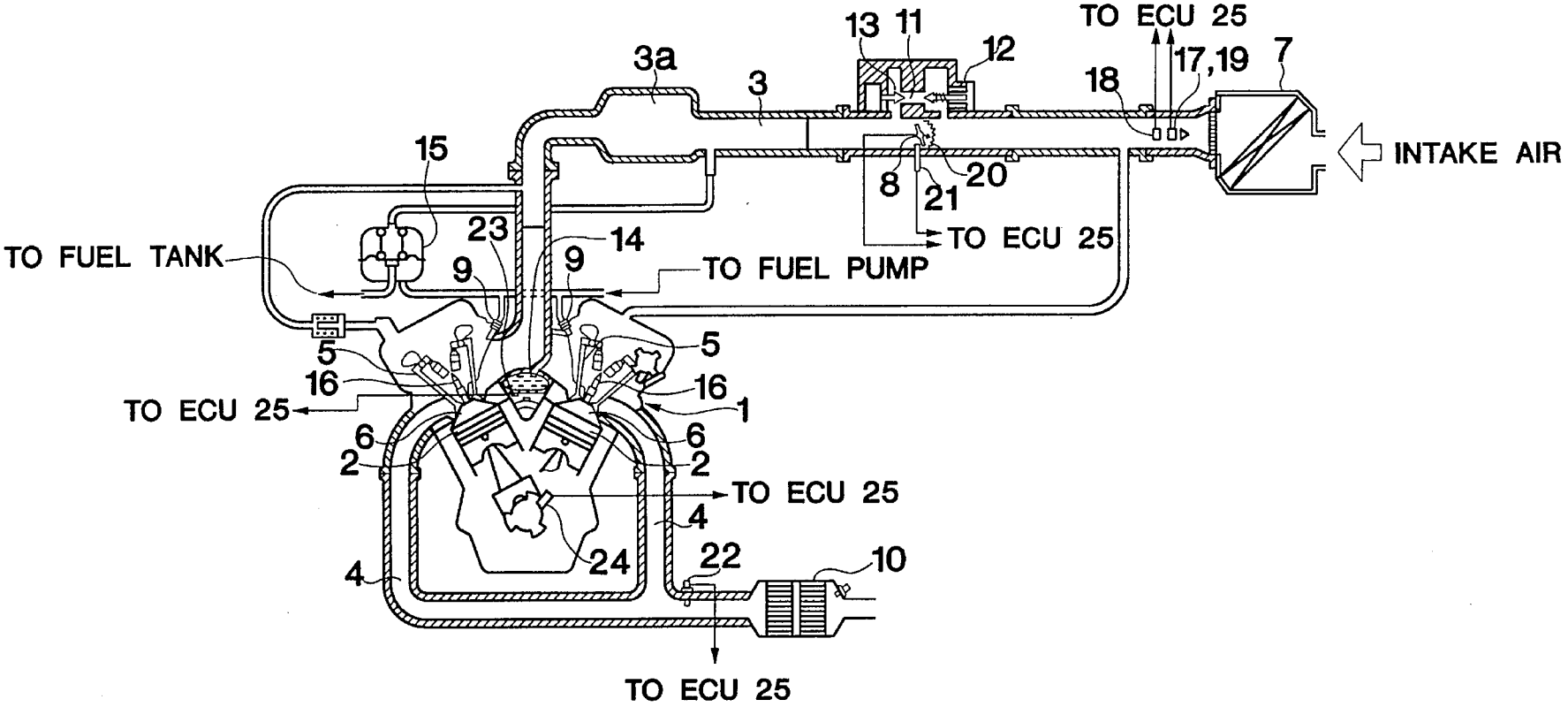
FIG. 3 is an overall construction diagram showing an engine system to which the device according to the embodiment is applied.

An engine system for an automotive vehicle, to which the system according to the present invention is applied, can be illustrated as shown in FIG. 3. In FIG. 3, the (internal combustion) engine which is designated at numeral 1 has an intake passage 3 and an exhaust passage 4, both of which are communicated to a combustion chamber 2. The communication between the intake passage 3 and the combustion chamber 2 is controlled by an intake valve 5, while the communication between the exhaust passage 4 and the combustion chamber 2 is controlled by an exhaust valve 6.

The intake passage 3 is provided with an air cleaner 7, a throttle valve 8 and an electromagnetic fuel injection valve (injector) 9, which are arranged successively from an upstream side of the intake passage 3. The exhaust passage 4, on the other hand, is provided with an exhaust-gas-cleaning catalytic converter (three-way catalyst) 10 and an unillustrated muffler (noise eliminator) successively from an upstream side of the exhaust passage 4. Further, the exhaust passage 3 is provided with a surge tank 3*a*. In addition, the throttle valve 8 is connected to an accelerator pedal (not shown) via a wire cable so that the position of the throttle valve 8 is regulated according to the stroke of the accelerator pedal.

Incidentally, the intake passage 3 is provided, as depicted in FIG. 3 and FIG. 4, with a bypass passage 11 which extends bypassing the throttle valve 8. Inserted in this bypass passage 11 is a stepper motor valve (hereinafter called the "STM valve"; the first control valve) 12 which functions as an ISC valve.

The STEM valve 12 is, as shown in FIG. 4, constructed of a valve element. 12*a* which can be brought into contact with a valve seat portion 11*a* formed on an upstream side in the bypass passage 11, a stepper motor 12*b* for controlling the position of the valve element 12*a*, and a spring 12*c* biasing the valve element 12*a* in the direction that the valve element is pressed against the valve seat 11*a* (i.e., in the direction that the bypass passage 11 is closed).

By adjusting the position of the valve element 12*a* stepwise (according to the number of steps) relative to the valve seat portion 11*a* (i.e. the position relative to the horizontal direction in the drawing) by the stepper motor 12*b*, the opening between the valve seat portion 11*a* and the valve element 12*a*, that is, the opening of the STM valve 12 can be controlled.

By controlling the opening of the STM valve 12 by ECU which will be described subsequently herein, intake air can be fed to the engine 1 through the bypass passage 11 during idling irrespective of operation of the accelerator pedal by the driver. By changing its opening, the quantity of air to be inducted through the throttle bypass passage can be controlled.

Further, a limiter (the second control valve) 13 is interposed in the bypass passage 11 so that the limiter is located in series with the STM valve 12. This limiter 13 is changed in opening in correspondence to the temperature state of the engine 1 and, as is illustrated in FIG. 4, is constructed of a valve element 13*a*, which can be brought into contact with a valve seat portion 11*b* formed on a downstream side in the bypass passage 11, and a drive unit 13*b* for adjusting the position of the valve element 13*a*.

The drive unit 13*b* of the limiter 13 is made, for example, of a wax or a bimetal. Its volume or shape is caused to vary in correspondence to the temperature state of the engine 1, so that the position of the valve element 13*a* relative to the valve seat portion 11*b* (i.e., the position-relative to the horizontal direction in the drawing) can be adjusted in a stepless manner to control the opening between the valve seat portion 11*b* and the valve element 13*b*, that is, the opening of the limiter 13.

Around an outer peripheral portion of the drive unit 13*b* of the limiter 13, a coolant 14 for the engine 14 is introduced very close to the outer peripheral portion so that the drive unit 13*b* is operated under the influence of the temperature of the coolant 14 as the temperature state of the engine 1. As the limiter 13, a butterfly valve of the bimetal type can be used as a specific example.

The opening of the limiter 13, that is, the position of the valve element 13*a* is controlled by the drive unit 13*b* so that the valve element is fully opened (i.e., is brought to a most opened position), for example, at −30° C. when the temperature state of the engine (i.e., the temperature of the coolant 14) is low but is fully closed (i.e., is brought to a most closed position at which the valve element is not fully closed and some intake air is still allowed to pass through the bypass passage 11), for example, at +40° C. when the temperature state of the engine 1 is high. This control of the opening of the limiter 13 is performed by the drive unit 13*b* in a manner fully independent from the below-described control of the opening of the STM valve 12 by ECU.

By the limiter 13 as described above, the maximum quantity of intake air which is allowed to pass through the bypass passage 11 at the time of a hot state is limited, thereby making it possible to avoid any unnecessarily high increase in the idling speed at the time of the hot state.

In FIG. 3, numeral 15 indicates a fuel pressure regulator. This fuel pressure regulator 15 is actuated responsive to a negative pressure in the intake passage 3 to control the quantity of fuel to be returned from an unillustrated fuel pump to an unillustrated fuel tank, so that the pressure of fuel to be injected from the injector 9 can be controlled.

Owing to the construction as described above, air—which has been inducted through the air cleaner 7 in accordance with the opening of the throttle valve 8 and also the openings of the STM valve 12 and the limiter 13—is mixed with fuel from the injector 9 at the place of an intake mainfold to achieve an appropiate air/fuel ratio. By actuating the spark plug 16 at an adequate timing within the combustion chamber 2, the resulting air-fuel mixture is caused to burn so that an engine torque is produced. The air-fuel mixture is then exhausted at exhaust gas into the exhaust passage 4 and, subsequent to purification of the three toxic components CO, HC and NOx in the exhaust gas through the catalytic converter 10, is deadened in noise and then released to a side of the surrounding atmosphere.

To control the operation state of the engine 1, various sensors are arranged. First, as is shown in FIG. 3, a portion where intake air flowed past the air cleaner 7 flows into the intake passage 3 is provided with an air flow sensor (inducted air quantity sensor) 17 for detecting the quantity of the inducted air from Karman vortex information, an intake air temperature sensor 18 for detecting the temperature of the intake air, and an atmospheric pressure sensor 19 for detecting the atmospheric pressure.

At the position of arrangement of the throttle valve 8 in the intake passage 3, there are arranged a throttle position sensor 20 in the form of a potentiometer for detecting the position of the throttle valve 8 as well as an idling switch 21 for mechanically detecting a fully-closed state of the throttle valve 8 (i.e., an idling state) from the position of the throttle valve 8.

On the side of the exhaust passage 4, on the other hand, an oxygen concentration sensor (hereinafter referred to simply as the "$O_2$ sensor") 22 for detecting the concentration of oxygen ($O_2$ concentration) in the exhaust gas is disposed on an upstream side of the catalytic converter 10. Other sensors include a coolant temperature sensor 23 for detecting the temperature of the coolant 14 for the engine 1, a crank angle sensor 24 for detecting a crank angle (which can also function as a speed sensor for detecting an engine speed Ne), etc.

Figure 2:
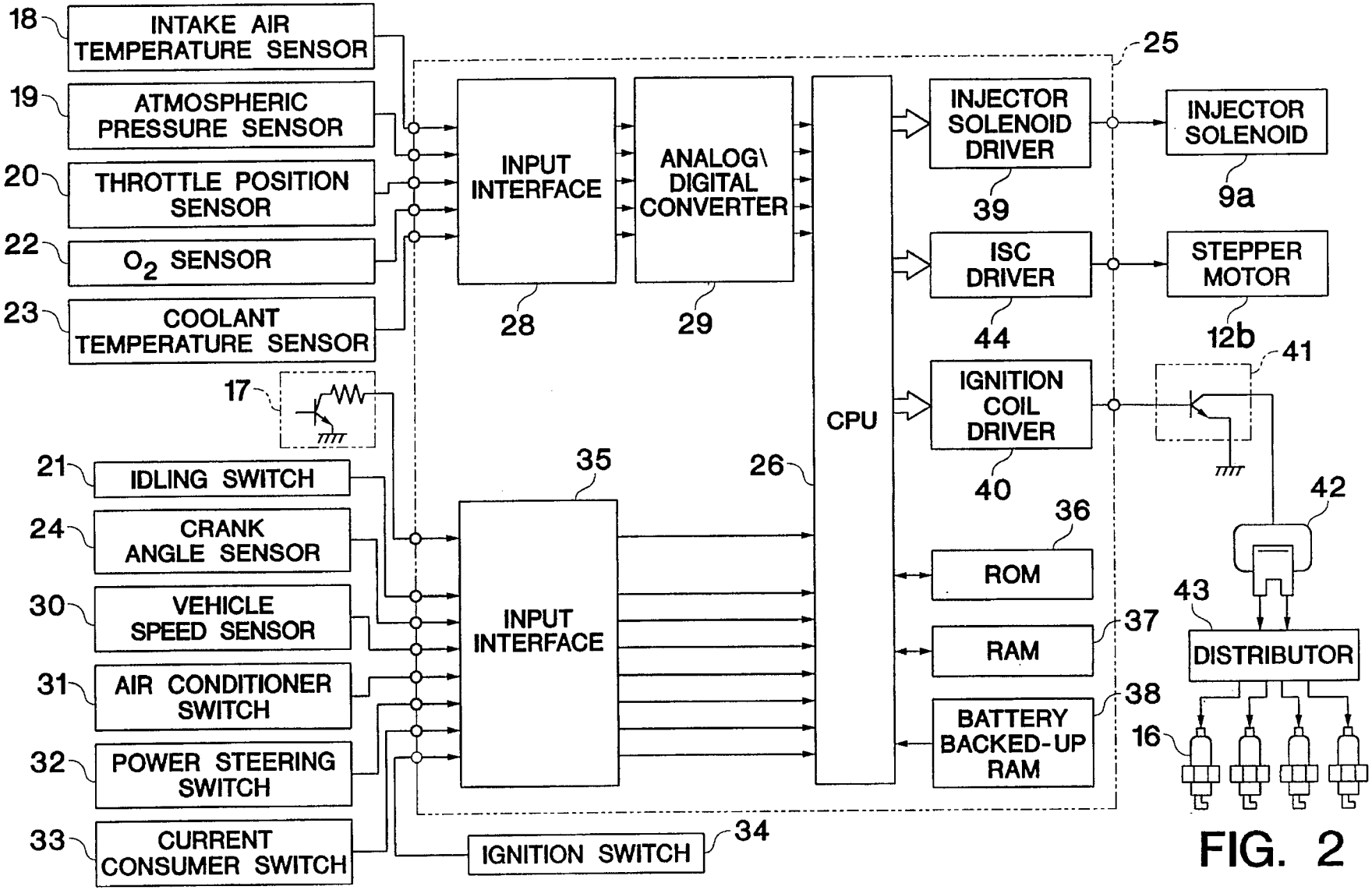
FIG. 2 is a hardware block diagram of the control system for the device according to the embodiment.

Detection signals from these sensors and switch are inputted to an electronic control unit (ECU) 25 as shown in FIG. 2.

The hardware construction of ECU 25 can be illustrated as shown in FIG. 2. ECU 25 is provided as a principal component thereof with CPU (processor) 26. To CPU 26, detection signals from the intake air temperature sensor 18, the atmospheric pressure sensor 19, the throttle position sensor 20, the $O_2$ sensor 22 and the coolant temperature sensor 23 are inputted via an input interface 28 and an analog/digital converter 29.

Directly inputted through an input interface 35 to CPU 26 are detection signals from the air flow sensor 17, the idling switch 21, the crank angle sensor 24, the vehicle speed sensor 30 and the like; and on/off signals from an air conditioner switch 31, a power steering switch 32, current consumer switches (switches of fog lamps, head lamps and the like) 33, an ignition switch (key switch) 34 and the like.

Through a bus line, CPU 26 also exchanges data with ROM (memory means) 36, in which various data to be described subsequently with reference to FIG. 6 through FIG. 10 are stored along with program data and fixed value data, and also with RAM 37 which is updated, that is, successively rewritten and also with battery backed-up RAM 38 whose stored contents are held as long as it is connected to a battery.

Incidentally, the data in RAM 37 are cleared and reset when the ignition switch 34 is turned off.

As a result of computation by CPU 26, ECU 25 outputs signals for controlling the state of operation of the engine 1 and the states of various accessories and the like, for example, various control signals such as a fuel injection control signal, an idling speed control signal, an air conditioner control signal, a fuel pump control signal, an ignition timing control signal, an engine check lamp lighting signal, and an alarm lamp lighting signal.

Of these control signals, the fuel injection control (air/fuel ratio control) signal is outputted from CPU 26 to an injector solenoid 9*a* (precisely, a transistor for the injector solenoid 9*a*), which is arranged to drive the injector 9, via an injector solenoid driver 39. Further, the ignition timing control signal is outputted from CPU 26 to a power transistor 39 via an ignition coil driver 40, so that the individual spark plugs 16 are successively caused to produce sparks through the power transistor 41, an ignition coil 42 and a distributor 43. Further, the ISC control signal is outputted from CPU 26 to the stepper motor 12*b* for the STM valve 12 via an ISC driver (which functions in FIG. 1 as the valve opening setting means to be described subsequently herein) 44.

Figure 1:
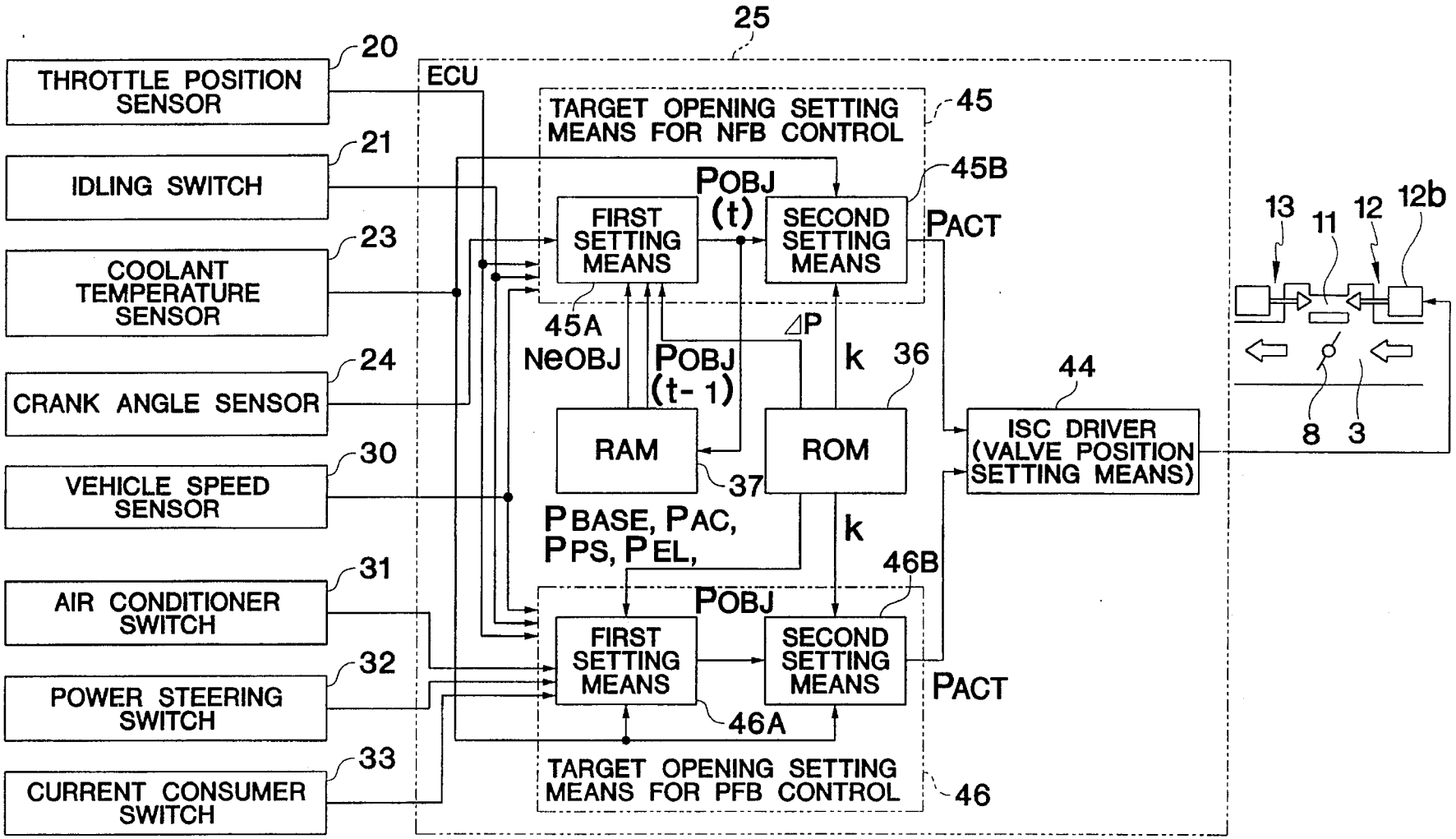
FIG. 1 is a block diagram showing, as one embodiment of the present invention, a control system for a control device for the quantity of air to be inducted into an engine.

Now paying attention to the idling speed control during idling, ECU 25 is provided, as shown in FIG. 1, with target opening setting means for revolution number feedback (NFB) control and also with target opening setting means 46 for position feedback (PFB) control.

Further, ROM 36 employed in the present embodiment stores opening setting opening data for the STM valve 12, said opening setting opening data having been set in advance corresponding to operation states of the engine 1, and also correction data (correction coefficients k) to be used upon correction of target openings at the target opening setting means 45,46, and stores, for example, the below-described data (1) to (4) or the like in the form of functions or a map or table.

In the present embodiment, each opening data for the STM valve 12 is set in terms of a corresponding number of drive steps by the stepper motors 12*b*.

Figure 6:
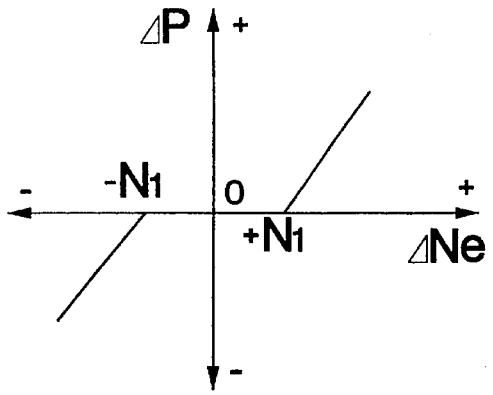
FIG. 6 is a graph showing illustrative opening data corresponding to differences between engine speeds and target engine speeds, said opening data being used upon NFB in the present embodiment.

(1) Data for use upon NFB control, for example, opening data (corrected positions) ΔP corresponding to speed differences ΔNe between engine speeds Ne (as detected by the crank angle sensor 24) and target engine speeds $Ne_{OBJ}$, as illustrated in FIG. 6.

Figure 7:
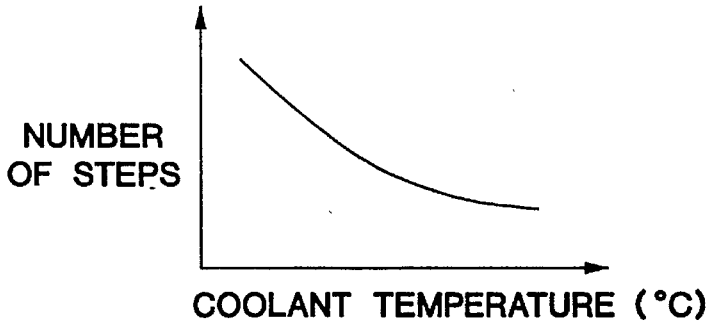
FIG. 7 is a graph depicting illustrative first opening data corresponding to temperature states of the engine, said first opening data being used upon PFB in the present embodiment.

(2) Date for use upon PFB control, for example, first opening data (basal opening data upon PFB control) $P_{BASE}$ corresponding to temperature states of the engine 1 (i.e., coolant temperatures as detected by the coolant temperature sensor 23), as illustrated in FIG. 7.

(3) Date for use upon PFB control, for example, second opening data corresponding to operation states of various accessories to the engine 1 (in the present embodiment, corrected opening data $P_{AC}$ corresponding to operations of the air conditioner, corrected opening data $P_{PS}$ corresponding to operations of the power steering, and corrected opening data $P_{EL}$ corresponding to operations of current consumers).

Figure 8:
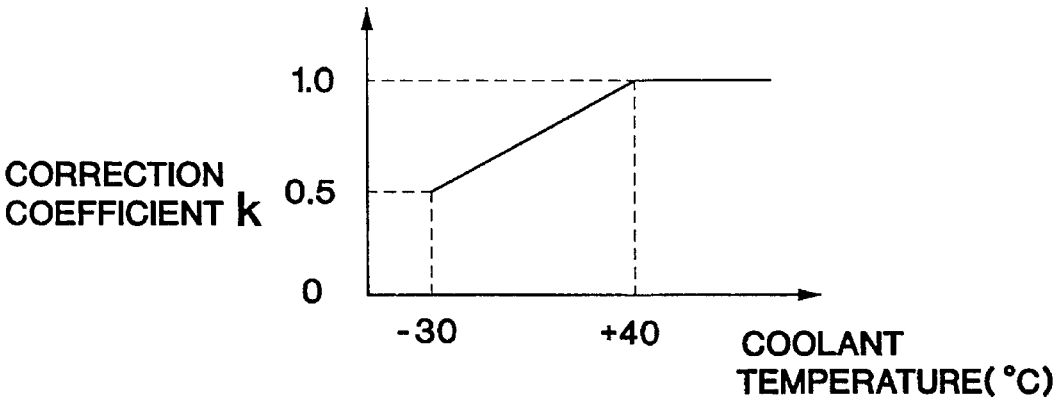
FIG. 8 is a graph showing illustrative correction coefficients corresponding to information on temperature states of the engine, said correction coefficients being used upon PFB in the present embodiment.
Figures 9, 10:
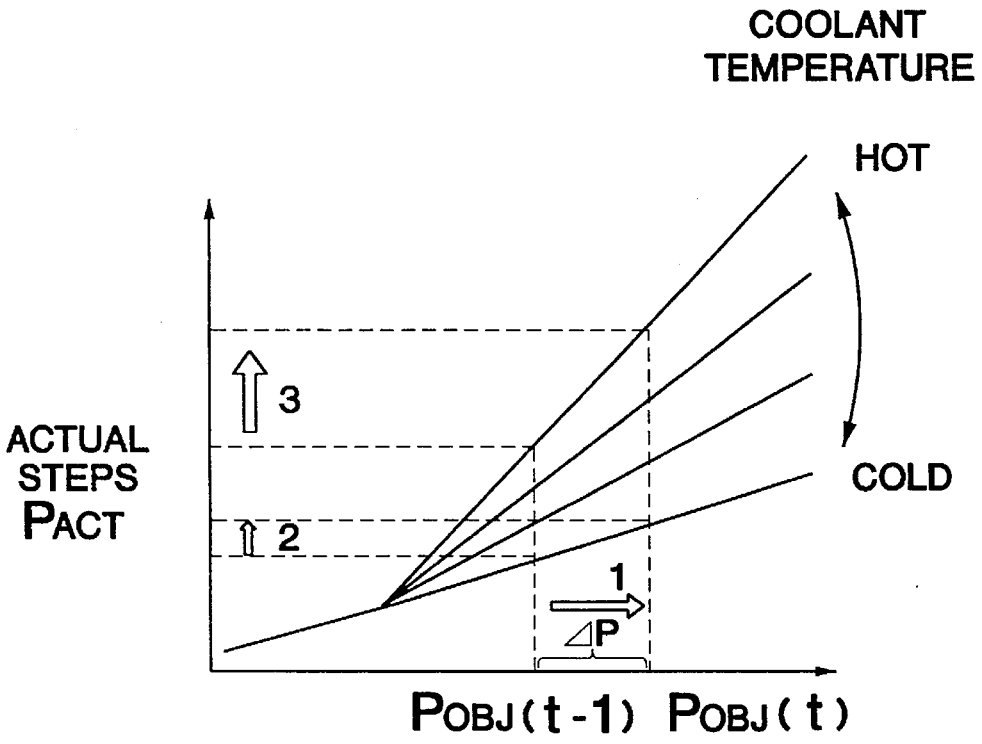
FIG. 9 is a chart depicting an illustrative table of correction coefficients corresponding to information on temperature states of the engine and information on openings of an STEM valve in the present embodiment.
FIG. 10 is a graph for describing an advantageous effect available from the correction of a tentative target opening in the present embodiment.

(4) Correction data (correction coefficients k which multiply tentative target openings to be described subsequently herein) for use upon correction of target openings at the target opening setting means 45,46, for example, correction coefficients k corresponding to information on temperature states of the engine (i.e., coolant temperatures as detected by the coolant temperature sensor 23) as illustrated in FIG. 8 i.e., those set at 0.5 when the coolant temperature is −30° C., linearly increasing up to +40° C., and set at 1.0 at +40° C. and higher), or correction coefficients k corresponding to information on temperature states of the engine and information on openings of STM valve 12 (i.e., tentative target openings $P_{OBJ(t)}$ or $P_{OBJ}$ to be described subsequently herein) as illustrated in FIG. 9 [i.e., those set smaller as the coolant temperature decreases or the actual opening (number of steps) of the STM valve 12 increases; 0.5 at the minimum and 1.0 at the maximum].

Incidentally, the above-described opening data (1)–(3) are set corresponding to a time at which the temperature of the coolant 14 is high (for example, +40° C.) and the limiter 13 is most closed.

On the other hand, RAM 37 employed in the present embodiment stores, for example, a target engine speed $Ne_{OBJ}$ needed upon reading the above-described opening data (1) and information on an opening of the STM valve 12 (i.e., $P_{OBJ(t-1)}$ set immediately before by a first setting means 45) required upon calculation of a tentative target opening $P_{OBJ(1)}$ at the first setting means 45A of the NFB opening setting means 45 as will be described subsequently herein. The target engine speed $Ne_{OBJ}$ can be stored in ROM 36.

The NFB target opening setting means 45 and the PFB target opening setting means 46 are operated when the engine 1 is in an idling state (i.e., when the idling switch 21 is ON). They receive from ROM 36 opening data corresponding to the state of operation of the engine 1 (i.e., information obtained from the switches 31–33 and the sensors 20,23,24) and set a tentative target opening $P_{OBJ}$ for the STM valve 12. They also obtain a correction coefficient k from ROM 36 on the basis of at least one of information on the state of temperature of the engine 1 from the coolant sensor 23 and information on an opening of the STM valve 12, correct the tentative target opening $P_{OBJ}$ by the correction coefficient k and hence set an actual target opening $P_{ACT}$.

Here, the NFB target opening setting means 45 operates during idling in stoppage and performs feedback control of the opening of the STM valve 12 so that the speed Ne of the engine 1 can be controlled to the target engine speed $Ne_{OBJ}$ stored in RAM 37. The NFB target opening setting means is constructed of the first setting means 45A an second setting means 45B.

The first setting means 45A reads from RAM 37 the tentative target opening $P_{OBJ(t-1)}$ set immediately before and also reads from ROM 36 the opening data ΔP corresponding to the difference ΔNe in engine speed between the engine speed Ne detected by the crank angle sensor 24 and the target engine speed $Ne_{OBJ}$ stored in RAM 37. Based on both the tentative target opening $P_{OBJ(t-1)}$ and the opening data ΔP, the first setting means sets the tentative opening $P_{OBJ(t)}$ ($=P_{OBJ(t-1)}+\Delta P$).

Further, the second setting means 45B reads from ROM 36 the correction coefficient k corresponding to at least one of the information on the state of the temperature of the engine 1 from the coolant temperature sensor 23 and the information on the opening of the STM 12 from RAM 37, multiplies the tentative target opening $P_{OBJ(t)}$, which has been set by the first setting means 45A, by the correction coefficient k to correct the tentative target opening $P_{OBJ(t)}$ and sets the thus-corrected value as the actual target opening $P_{ACT}$ ($=k \cdot P_{OBJ(t)}$).

The PFB target opening setting means 46, on the other hand, operates at the time of idling in running and also at the time of operation of one or more of the accessories during idling. To obtain high responsibility, the PFB target opening setting means performs direct control (actually, open-loop control) with respect to the opening (position, the number of steps) of the STM valve 12. The PFB target opening setting means is constructed of first setting means 46A and second setting means 46B.

The first setting means 46A reads from ROM 36 the first opening data $P_{BASE}$ corresponding to the state of temperature of the engine 1 from the coolant sensor 23 an also reads the second opening data $P_{AC}$, $P_{PS}$, $P_{EL}$ corresponding to the states of operations of the various accessories to the engine 1, said second opening data being obtained as on/off signals of the switches 31–33, and by using (adding) these data together, sets the tentative target opening $P_{OBJ}$.

On the other hand, the second setting means 46B, like the second setting means 45B described above, reads from ROM 36 the correction coefficient k corresponding to at least one of the information on the state of temperature of the engine 1 from the coolant temperature sensor 23 and the information on the opening of the STM valve 12 from RAM 37, multiplies the tentative target opening $P_{OBJ}$, which has been set by the first setting means 46A, by the correction coefficient k to correct the tentative target opening $P_{OBJ}$ and sets the thus-corrected value as the actual target opening $P_{ACT}$ ($=k \cdot P_{OBJ}$).

In the present embodiment, the ISC driver 44 is designed to function as valve opening setting means for controlling the opening of the STM valve 12 to the actual target opening $P_{ACT}$ which has been set by the target opening setting means 45 or 46.

The tentative target opening $P_{OBJ(t)}$ set by the first setting means 45A in the NFB target opening setting means 45 is stored in RAM 37, so that it can be used as the tentative target opening $P_{OBJ(t-1)}$ set immediately before and needed upon setting the next tentative target opening $P_{OBJ(t)}$.

Next, idling speed control by the system of this embodiment constructed as described above will be described using the flow chart of FIG. 5.

Figure 5:
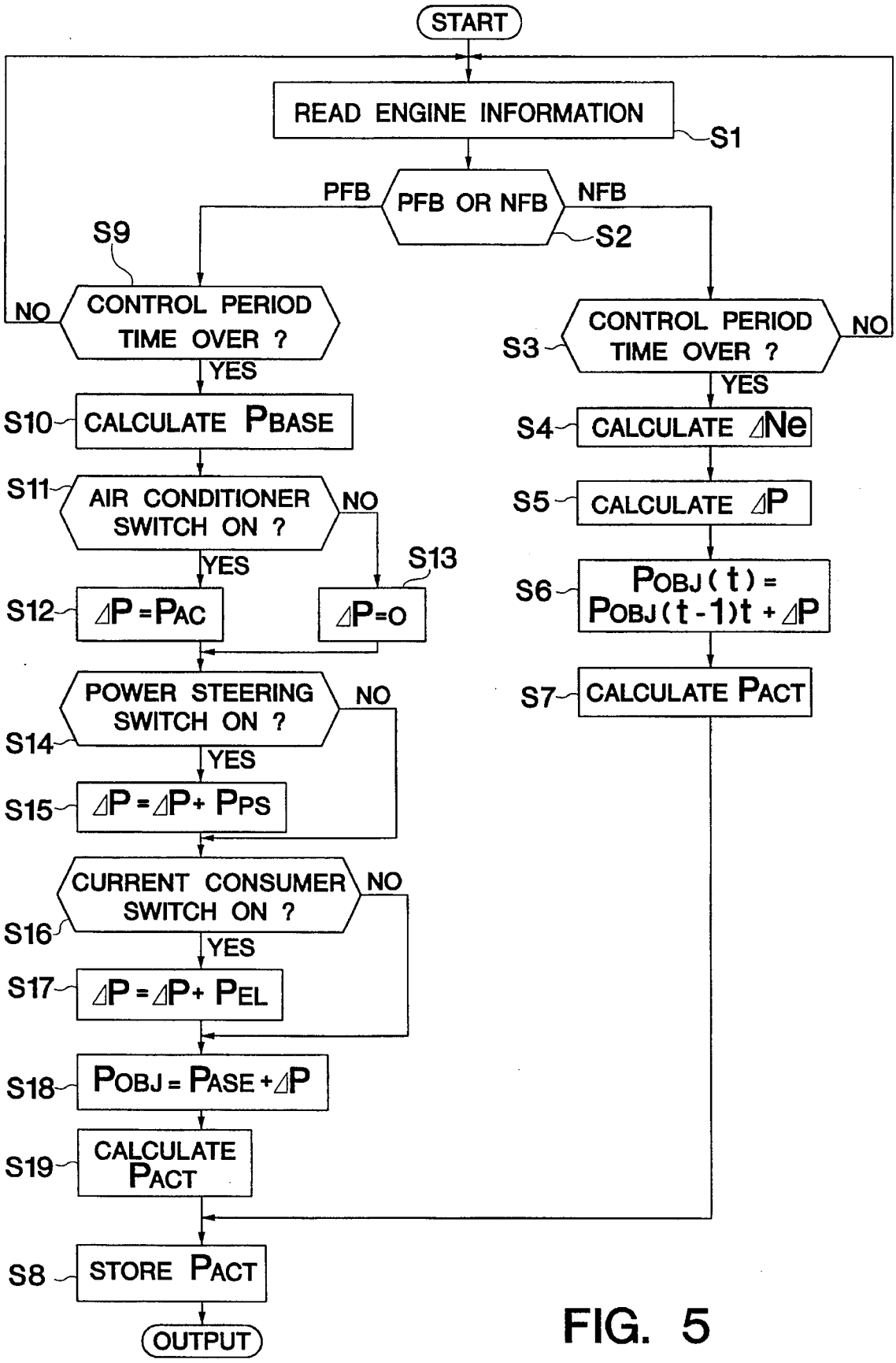
FIG. 5 is a flow chart for describing the manner of control by the device according to this embodiment.

The idling speed control which is performed in accordance with the procedures shown in FIG. 5 is started upon detection of an ON state of the idling speed switch 21 and also an idling state of the engine 1. First read in CPU 26 of ECU 25 are information on the state of operation of the engine 1, for example, an engine speed Ne from the crank angle sensor 24, a coolant temperature from the coolant temperature sensor 23 (information on the state of temperature of the engine 1), vehicle speed information from the vehicle speed sensor 30, and on/off signals from the switches 31–33 for various accessories as well as an A/N ratio from the air flow sensor 16, an intake air temperature from the intake air temperature sensor 18, an atmospheric pressure from the atmospheric pressure sensor 19, and the like (step S1).

Based on the vehicle speed information from the vehicle speed sensor 30 and the on/off signals from the switches 31–33 for the various accessories, it is then determined whether the engine is in an idling state in stoppage or in an idling or accessory-operated state in running. When the engine is in the idling state in stoppage, the revolution number feed back control (NFB) is selected to have the NFB target opening setting means 45 operated. When the engine is in the idling or accessory-operated state in running, the position feed back (PFB) control is selected to have the PFB target opening setting means 46 operated (step S2).

When the NFB control has been selected in step S2, a timer is started to determine if a control period (for example, 1 second) has elapsed (step S3), so that the processing and control can be performed in every control period. If the control period is over, processings in the below-described steps S4 to S8 are performed by the NFB target opening setting means 45 on the basis of data read at that time point.

Namely, the engine speed difference ΔNe between the engine speed Ne detected by the crank angle sensor 24 and the target engine speed $Ne_{OBJ}$ stored in RAM 37 is calculated at the first setting means 45A of the NFB target opening setting means 45 (step S4), and the opening data ΔP corresponding to the engine speed difference ΔNe is read or calculated in accordance with data stored in ROM 36, for example, those shown in FIG. 6 (step S5). The opening data ΔP can be stored in advance in ROM 36 as data corresponding to the engine speed difference ΔNe, or can be calculated by storing in advance a function on engine speed differences ΔNe, said function being capable of affording such data as shown in FIG. 6, in ROM 36, reading the function from ROM 36 and then introducing the engine speed difference ΔNe into the function.

With respect to the opening data ΔP, a dead zone is set so that, as is illustrated in FIG. 6, ΔP becomes 0 when the absolute value of an engine speed difference ΔNe is not greater than a predetermined value $N_1$ (>0). When the engine speed difference ΔNe is greater than $+N_1$, ΔP is set at a value which is proportional to $(\Delta N_1-N_1)$. When the engine speed difference ΔNe is smaller than $-N_1$, ΔP is set at a value which is proportional to $(\Delta Ne+N_1)$. A change ΔP to the opening of the STM valve 12, said change being required to reduce the engine speed difference ΔNe to 0, is calculated.

At the first setting means 45A of the NFB target opening setting means 45, the tentative target opening $P_{OBJ(t-1)}$ set immediately before (i.e., at the time of the preceding control period) is read from RAM 37 and the opening data ΔP obtained as described above is added to the tentative target opening $P_{OBJ(t-1)}$, whereby the present tentative target opening $P_{OBJ(t)}=(P_{OBJ(t-1)}+\Delta P)$ is calculated and set. (step S6).

To the present tentative target opening $P_{OBJ(t)}$ obtained by the first setting means 45A, correction based solely on the coolant temperature from the coolant temperature sensor 23 (i.e., the information on the state of temperature of the engine 1) or correction based on the coolant temperature and the present tentative target opening $P_{OBJ(t)}$ is applied by the second setting means 45B, so that the actual target opening $P_{ACT}$ is calculated (step S7).

Here, to perform the correction based solely on the coolant temperature from the coolant temperature sensor 23 (i.e., the information on the state of temperature of the engine 1), a correction coefficient k in a range of 0.5 to 1.0, said correction coefficient corresponding to the coolant temperature from the coolant temperature sensor 23, is read from ROM 36 on the basis of such a graph as shown in FIG. 8, the present tentative target opening $P_{OBJ(t)}$ is multiplied by the correction coefficient k to correct the present tentative target opening $P_{OBJ(t)}$, and the value so corrected is set as the actual target opening $P_{ACT}$.

The correction coefficient k can be stored in advance as data corresponding to the coolant temperature from the coolant temperature sensor 23, Ne, or can be calculated by storing in advance a function on coolant temperatures, said function being capable of affording such data as shown in FIG. 8, in ROM 36, reading the function from ROM 36 and then introducing the coolant temperature into the function.

The correction coefficients k shown in FIG. 8 has been set as described above so that it is at 0.5 when the coolant temperature is −30° C., linearly increases up to +40° C., and is at 1.0 at +40° C. and higher. Further, the present tentative target opening $P_{OBJ(t)}$ calculated in step S6 is set as described above so that it is set corresponding to the state that the coolant temperature is +40° C. and the limiter 13 is most closed.

Accordingly, the correction coefficient k becomes 1.0 when the coolant temperature is +40° C. or higher so that the present tentative target opening $P_{OBJ(t)}$ is set as is. In the coolant temperature range from +40° C. to −30° C. at which the limiter 13 is brought into the most opened state, the correction coefficient k ranges from 1.0 to 0.5 so that the present tentative target opening $P_{OBJ(t)}$ is corrected by a smaller degree (to a half at the minimum) as the coolant temperature becomes lower and $k \cdot P_{OBJ(t)}$ is set as the actual target opening $P_{ACT}$.

With respect to both the state that the coolant temperature (engine temperature) is relatively low and the maximum bypass flow rate as set by the limiter 13 is relatively high and the state that the coolant temperature is relatively high and the maximum bypass flow rate as set by the limiter 14 is relatively low, there is the conventional tendency that, even if correction of the same degree (the same number of steps) is made to the opening of the STM valve 12 in a range of relatively large openings of the STM valve (ISC valve) 12, the influence of the limiter 13 is smaller and the change to the quantity of air to be inducted tends to become greater in the former state but the influence of the limiter 13 is greater and the change to the quantity of air to be inducted tends to become smaller in the latter state. Accordingly, the change to the quantity of air to be inducted by the STM valve 12 is affected by the engine temperature and is not made to the same extent.

By conducting the correction in step S7 as described above, it is however possible for the below-described reasons to perform the same change by the STM valve 12 to the quantity of air to be inducted without being affected by the engine temperature. As the temperature of the coolant becomes lower, the tentative target opening $P_{OBJ(t)}$ is corrected by a smaller degree to $k \cdot P_{OBJ(t)}$, which is then set as the actual target opening $P_{ACT}$. In FIG. 10, the correction coefficient k becomes greater at high temperatures, for example, with respect to such an increase ΔP in the opening as indicated by arrow ①. Although the increase in the actual target opening $P_{ACT}$ is substantially the same as ΔP as indicated by arrow ③, the correction coefficient k becomes smaller at low temperatures so that the increase in the actual target opening $P_{ACT}$ can be made smaller as indicated by arrow ②. It is hence possible to perform the change by the STM valve 12 to the quantity of air, which is to be inducted, to the same extent without being affected by the engine temperature.

It has been described in the above about the control in which in step S7, the correction coefficient k is determined based solely on the coolant temperature from the coolant temperature sensor 23 while using such a graph as shown in FIG. 8 and the correction of the present tentative target opening $P_{OBJ(t)}$ is then performed. To perform correction on the basis of the coolant temperature from the coolant temperature sensor 23 and the present tentative target opening $P_{OBJ(t)}$, a correction coefficient k in the range of 0.5 to 1.0, said correction coefficient corresponding to the coolant temperature from the coolant temperature sensor 23 and the present tentative target opening $P_{OBJ(t)}$, is read from ROM 36, for example, on the basis of such a table as shown in FIG. 9, the present tentative target opening $P_{OBJ(t)}$ is multiplied by the correction coefficient k to correct the present tentative target opening $P_{OBJ(t)}$, the value so corrected is then set as an actual target opening $P_{ACT}$. Here, correction coefficients k shown in FIG. 9 are set, as described above, smaller as the coolant temperature decreases and the actual opening (the number of steps) of the STM valve 12 increases (0.5 at the minimum and 1.0 at the maximum).

As a consequence, it is possible to perform a change by the STM valve 12 to the quantity of air, which is to be inducted, without being affected by the engine temperature as in the correction performed based solely on the coolant temperature from the coolant temperature sensor 23. Conventionally, under the same temperature conditions, the degree of influence of a limitation by the limiter 13 to the flow rate increases when the opening of the STM valve (ISC valve) 12 becomes relatively large. As shown in FIG. 9, the present tentative target opening $P_{OBJ(t)}$ is however considered even under the same temperature conditions so that the correction coefficient k is made smaller to give a smaller actual target opening $P_{ACT}$ as the value of the present tentative target opening $P_{OBJ(t)}$ increases (the opening becomes greater). The above control can therefore accurately obtain inducted air in a quantity inherently required depending on the degree of influence of the limiter 13 which varies based on the opening of the STM valve 12.

The actual target opening $P_{ACT}$ obtained in step S7 as described above is stored (step S8) and the opening of the STM valve 12 is controlled by the ISC driver 44 to the stored actual target opening $P_{ACT}$ from the NFB target opening setting means 45, so that during idling in stoppage, the opening of the STM valve 12 is feedback controlled to maintain the speed Ne of the engine 1 at the target engine speed $Ne_{OBJ}$ stored in RAM 37.

When the PFB control is selected in step S2, on the other hand, the timer is started as in step S3 to determine if a control period (for example, 1 second) has elapsed (step S9), so that the processing and control can be performed in every control period. If the control period is over, processings in the below-described steps S10–S19,S8 are performed by the PFB target opening setting means 46 on the basis of data read at that time point.

Namely, at the first setting means 46A of the PFB target opening setting means 46, the first opening data $P_{BASE}$ (the basal opening data for the time of the PFB control) corresponding to the coolant temperature (the state of temperature of the engine 1) from the coolant temperature sensor 23 is read in accordance with data stored in ROM 36, for example, those shown in FIG. 10 (step S10).

Incidentally, the first opening data $P_{BASE}$ can be stored in advance in ROM 36 as data corresponding to the coolant temperature or can be calculated by storing in advance a function on coolant temperatures, said function being capable of affording such data as shown in FIG. 10, in ROM 36, reading the function from ROM 36 and then introducing the coolant temperature into the function.

As is illustrated in FIG. 10, the first opening data $P_{BASE}$ is set, for example, as a function which is in inverse proportion to the coolant temperature so that the first opening data decreases as the coolant temperature becomes higher but increases as the coolant temperature becomes lower.

At the first setting means 46A of the PFB target opening setting means 46, the tentative target opening $P_{OBJ}$ ($=P_{BASE}+\Delta P$) is calculated and set by detecting the states of operations of the various accessories to the engine 1 [the air conditioner, the power steering, the current consumers (fog lamps, head lamps, etc.)] on the basis of on/off signals from the air conditioner switch 31, the power steering switch 32 and the current consumer switches 33, and when the individual switches 31–33 are ON, reading from ROM 36 the second opening data $P_{AC}$,$P_{PS}$,$P_{EL}$ corresponding to quantities of air to be increased in correspondence to the operations of the accessories and then adding these opening data $P_{AC}$, $P_{PS}$,$P_{EL}$ to the first opening data $P_{BASE}$ obtained in step S10 (steps S11–S18).

Namely, as is illustrated in FIG. 5, it is first determined in step S11 whether the air conditioner switch 31 is ON. If it is ON, the opening data $P_{AC}$ for the time of operation of the air conditioner is read and set as an increase ΔP in the opening data from ROM 36 (step S12). If it is OFF, 0 is set as an increase ΔP in the opening data (step S13).

It is next determined whether the power steering switch 32 is ON (step S14). If it is ON, the opening data $P_{PS}$ for the time of operation of the power steering is read from ROM 36 and is added to the increase ΔP in the opening data (step S15). Further, it is also determined whether the current consumer switches 33 are ON (step S16). If they are ON, the opening data $P_{EL}$ for the time of operation of the current consumers is read from ROM 36 and is added to the increase ΔP in the opening data (step S17).

The finally-obtained increase ΔP in the opening also determined whether the current consumer switches 33 are ON (step S16). If they are ON, the opening data $P_{EL}$ for the time of operation of the current consumers is read from ROM 36 and is added to the increase ΔP in the opening data (step S17).

The finally-obtained increase ΔP in the opening data is then added to the first opening data $P_{BASE}$ obtained in step S10, whereby the tentative target opening $P_{OBJ}$ is calculated and set (step S18).

To the tentative target opening $P_{OBJ}$ obtained by the first setting means 46A, correction based solely on the coolant temperature from the coolant temperature sensor 23 (i.e., the information on the state of temperature of the engine 1) or correction based on the coolant temperature and the present tentative target opening $P_{OBJ}$ is applied by the second setting means 46B in exactly the same manner as explained in step S7, so that the actual target opening $P_{ACT}$ is calculated (step S19).

The actual target opening $P_{ACT}$ obtained in step S19 as described above is stored (step S8) and the opening of the STM valve 12 is controlled by the ISC driver 44 to the stored actual target opening $P_{ACT}$ from the PFB target opening setting means 46, so that during idling in running or responsive to operations of the accessories during idling, the opening (the position or the number of steps) of the STM valve 12 is directly controlled with high responsibility.

As a result, where the STM valve 12 and the limiter 13 are arranged in series with each other in the bypass passage 11, the opening of the STM valve 12 is controlled while applying correction in accordance with the temperature state of the engine 1 (i.e., the coolant temperature) so that a change to the quantity of air, which is to be inducted for the compensation of a load, can be performed to the same extent without being affected by the engine temperature. Further, the use of such data as shown in FIG. 9 makes it possible to precisely obtain intake air in a quantity inherently required depending on the degree of influence of the limiter 13 which varies based on the opening of the STM valve 12.

In the embodiment described above, the description was made of the case where the system according to the present invention was applied to the engine (internal combustion engine) for the automotive vehicle. The system of the present invention is however not limited to the above embodiment. It can be applied likewise to engines employed as various power sources and the like and can bring about similar advantageous effects.

INDUSTRIAL APPLICABILITY

As has been described above, the control system according to the present invention for the quantity of air to be inducted into an engine is useful in controlling the idling speed not only in an engine for an automotive vehicle (an internal combustion engine) but also in engines employed as various power sources and the like, and is suited especially in controlling the idling speed of an engine in which an ISC valve and a limiter arranged in series with each other in a throttle valve bypass passage.

We claim:

1. A control system for the quantity of air to be inducted into an engine (1), comprising:

a first control valve (12) interposed in a bypass passage (11) which bypasses a throttle valve (8) disposed in an intake passage (3) of said engine (1);

means (36) for storing opening data for setting the position of said first control valve (12), said opening data having been preset corresponding to operation states of said engine (1);

a second control valve (13) interposed in said bypass passage (11) so that said second control valve is located in series with said first control valve (12), the opening of said second control valve being variable depending on the temperature state of said engine (1);

means (45,46) for setting a target opening of said first control valve (12) by detecting an operation state of said engine (1) and obtaining the opening data corresponding to the operation state from said storage means (36) and also for performing, upon setting the target opening on the basis of the opening data so obtained, correction of the target opening on the basis of at least one of information on a temperature state of said engine (1) and information on an opening of said first control valve (12); and valve opening setting means (44) for controlling the opening of said first control valve (12) to the target opening set by said target opening setting means (45, 46).

2. A control system according to claim 1, wherein said storage means (36) stores first opening data for a warm state of said engine (1) and second opening data corresponding to operation states of an accessory of said engine (1); and said target opening setting means (46) comprises:

first setting means (46A) for setting a tentative target opening by using both the first opening data and the second opening data, and second setting means (46B) for making correction to the tentative opening, which has been set by said first setting means (46A), on the basis of at least one of the information on the temperature state of said engine (1) and the information on the opening of said first control valve (12) and hence setting the target opening.

3. A control system according to claim 1, wherein said storage means (36) stores the opening data corresponding to a difference between an engine speed and a target engine speed; and said target opening setting means (45) comprises:

first setting means (45A) for setting a tentative target opening by using both another tentative target opening, which has been set immediately before, and the opening data, and a second setting means (45B) for making correction to the tentative target opening, which has been set by said first setting means (45A), on the basis of at least one of the information on the temperature state of said engine (1) and the information on the opening of said first control valve (12) and hence setting the target opening.

4. A control system according to claim 1, wherein said target opening setting means (45,46) makes the correction to the target opening on the basis of both the information on the temperature state of said engine (1) and the information on the opening of said first control valve (12).

5. A control system according to claim 1, wherein said storage means (36) stores target opening correcting correction coefficients corresponding to at least one of information on temperature states of said engine (1) and information on openings of said first control valve (12); and said target opening setting means (45,46) obtains from the storage means (36) the correction coefficient corresponding to at least one of information on a temperature state of said engine (1) and information on an opening of said first control valve (12) and multiplies the target opening by the correction coefficient so obtained, whereby the correction of the target opening is performed.

6. A control system according to claim 5, wherein the correction coefficients are set so that the correction coefficients become smaller as the temperature of said engine (1) decreases or the opening of said first control valve (12) increases.

7. A control system according to claim 4, wherein said storage means (36) stores target opening correcting correction coefficients as a map corresponding to the information on the temperature state of said engine (1) and the information on the opening of said first control valve (12); and said target opening setting means (45,46) obtains from the map in said storage means (36) the correction coefficient corresponding to the information on the temperature state of said engine (1) and the information on the opening of said first control valve (12) and multiplies the target opening by the correction coefficient so obtained, whereby the correction of the target opening is performed.

8. A control system according to claim 7, wherein said correction coefficients are set so that the correction coefficients become smaller as the temperature of said engine (1) decreases or the opening of said first control valve (12) increases.

* * * * *